US007337752B2

(12) United States Patent
Boros et al.

(10) Patent No.: US 7,337,752 B2
(45) Date of Patent: Mar. 4, 2008

(54) INSTANTANEOUS FUEL-FIRED WATER HEATER WITH LOW TEMPERATURE PLASTIC VENT STRUCTURE

(75) Inventors: Jozef Boros, Montgomery, AL (US); Subbu Thenappan, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 311 days.

(21) Appl. No.: 11/242,812

(22) Filed: Oct. 3, 2005

(65) Prior Publication Data

US 2007/0084420 A1 Apr. 19, 2007

(51) Int. Cl.
*F24D 19/00* (2006.01)

(52) U.S. Cl. ..... 122/15.1; 122/18.1; 122/40

(58) Field of Classification Search ..... 122/40, 122/41, 15.1, 18.1; 126/80, 110 R, 116 R, 126/290, 312, 307 R
See application file for complete search history.

(56) References Cited

U.S. PATENT DOCUMENTS 2,517,446 A * 8/1950 Ryder et al. ..... 431/202
3,926,173 A 12/1975 Jury
4,033,320 A 7/1977 Jury
4,300,527 A 11/1981 Montague
4,306,539 A 12/1981 Silva
4,686,940 A * 8/1987 Fullemann ..... 122/31.1
5,012,793 A 5/1991 Guzorek
5,255,665 A 10/1993 Windon
5,697,330 A 12/1997 Yetman et al.
5,941,230 A 8/1999 Rutz et al.
6,000,391 A 12/1999 Timmons
6,014,966 A * 1/2000 Stevenson ..... 126/110 R
6,112,741 A 9/2000 Stickford et al.
RE37,389 E 9/2001 Rutz et al.
6,398,512 B2 6/2002 Stewart
6,412,447 B1 7/2002 Trant et al.
6,415,744 B1 * 7/2002 Choi ..... 122/18.1
6,622,660 B1 9/2003 Bajic et al.
6,622,661 B1 9/2003 Hotton
6,662,758 B1 * 12/2003 Shin ..... 122/18.1
2004/0258546 A1 12/2004 Gatley, Jr.

* cited by examiner

*Primary Examiner*—Gregory A. Wilson
(74) *Attorney, Agent, or Firm*—Haynes and Boone, LLP

(57) ABSTRACT

An instantaneous type fuel-fired water heater has a variable speed blower that discharges combustion air into a fuel burner utilized to heat water flowing through a heat exchanger portion of the water heater. A portion of the air discharged from the blower bypasses the burner and associated heat exchanger, flows around the heat exchanger, and then mixes with flue gases being discharged from the heat exchanger portion into the flue portion of the water heater. In this manner, such flue gases are cooled by the bypassing blower discharge air to an extent permitting the flue portion to be formed from a low cost plastic material instead of a high temperature metal material such as stainless steel.

30 Claims, 3 Drawing Sheets

INSTANTANEOUS FUEL-FIRED WATER HEATER WITH LOW TEMPERATURE PLASTIC VENT STRUCTURE

BACKGROUND OF THE INVENTION

The present invention generally relates to fuel-fired heating appliances and, in representatively illustrated embodiments thereof, more particularly provides a fuel-fired instantaneous water heater having a special construction that permits it to utilize a low temperature plastic vent structure.

Fuel-fired instantaneous type water heaters have combustion systems designed to heat water as it is being supplied to one or more plumbing fixtures to which it is operatively connected as opposed to heating a stored quantity of water for subsequent delivery to such fixtures. Due to their high flue exhaust temperatures, conventional power vented instantaneous fuel fired water heaters installed indoors have typically had to utilize category III high grade stainless steel (AL-29-4C) vent systems and materials. These necessary stainless steel vent systems, which are usually specified and/or supplied in kit form with the water heater, are expensive, difficult to install, non-interchangeable across various manufacturers, and difficult to source through retail and wholesale distribution centers.

It would be highly desirable to provide a fuel-fired instantaneous type water heater which could utilize a lower cost plastic vent system instead of the conventionally required stainless steel vent system. It is to this goal that the present invention is primarily directed.

SUMMARY OF THE INVENTION

In carrying out principles of the present invention, in accordance with representative embodiments thereof, a fuel-fired fluid heating apparatus is provided which is illustratively a fuel-fired instantaneous type water heater. Because of a unique design of the heating apparatus a low cost plastic vent system may be utilized therewith instead of a conventional, more costly metal vent system.

From a broad perspective, the fuel-fired fluid heating apparatus comprises an outer housing having a combustion gas outlet opening, and a heat exchanger disposed in the outer housing. The heat exchanger structure has a first flow path extending therethrough and adapted to receive and discharge a flow of fluid to be heated, and a second flow path extending therethrough, the second flow path being in thermal communication with the first flow path and adapted to receive a flow of hot combustion gas and discharge the combustion gas flow through the combustion gas outlet opening.

A wall structure defines a third flow path external to the heat exchanger structure, and the heating apparatus further comprises a fuel burner operative to receive fuel and pressurized combustion air from sources thereof combust the received fuel and combustion air, and create the flow of hot combustion gas. Blower apparatus is incorporated in the heating apparatus and is operative to (1) discharge a first flow of air into the fuel burner as pressurized combustion air, and (2) discharge a second flow of air into the third flow path as cooling air which mixed with and cools combustion gas being discharged from the second flow path.

The use of blower-discharged air as combustion air delivered to the burner, and heat exchanger-bypassing cooling air to reduce the temperature of combustion gas discharged from the fluid heating apparatus permits the temperature of the cooled combustion gas to be less than about 200° F. so that a low cost plastic vent system can be connected to the outer housing, at the combustion gas outlet opening therein, to receive and discharge the cooled combustion gas.

According to other aspects of the invention, the first flow path is enveloped by the second flow path, with the first flow path being defined by a pipe-based heat exchanger disposed within a combustion chamber through which the second flow path extends. Preferably, the third flow path is interposed between and at least partially bounded by an interior surface portion of the outer housing and an exterior surface portion of the heat exchange structure. Preferably a fourth flow path is also disposed within the outer housing, between the heat exchanger structure and a portion of the outer housing, for flowing ambient air through the outer housing to an inlet portion of the blower apparatus. Air flow through the third and fourth flow paths serves to reduce the exterior surface temperature of the outer housing.

Preferably, the fuel burner is a variable firing rate fuel burner, and the blower apparatus is operative to discharge a selectively variable quantity of air. The fluid heating apparatus illustratively includes a temperature sensor operative to sense the temperature of the cooled combustion gas and responsively output a sensed temperature signal, and a control system operative to utilize the sensed temperature signal to control at least one operational aspect of the fluid heating apparatus.

In a first representative embodiment thereof, the blower apparatus includes a single air blower having an outlet communicating with the fuel burner and the third flow path. In a second representative embodiment thereof, the blower apparatus includes a single air blower, and the fluid heating apparatus further comprises proportioning apparatus operative to supply selectively variable portions of air discharged from the single air blower to the fuel burner and to the third flow path. In a third representative embodiment thereof, the blower apparatus includes a first air blower operative to discharge air only into the fuel burner, and a second air blower operative to discharge air only into the third flow path. Preferably, the blower apparatus, in each of its three illustrative embodiments, is disposed within the outer housing.

DETAILED DESCRIPTION

Figure 1:
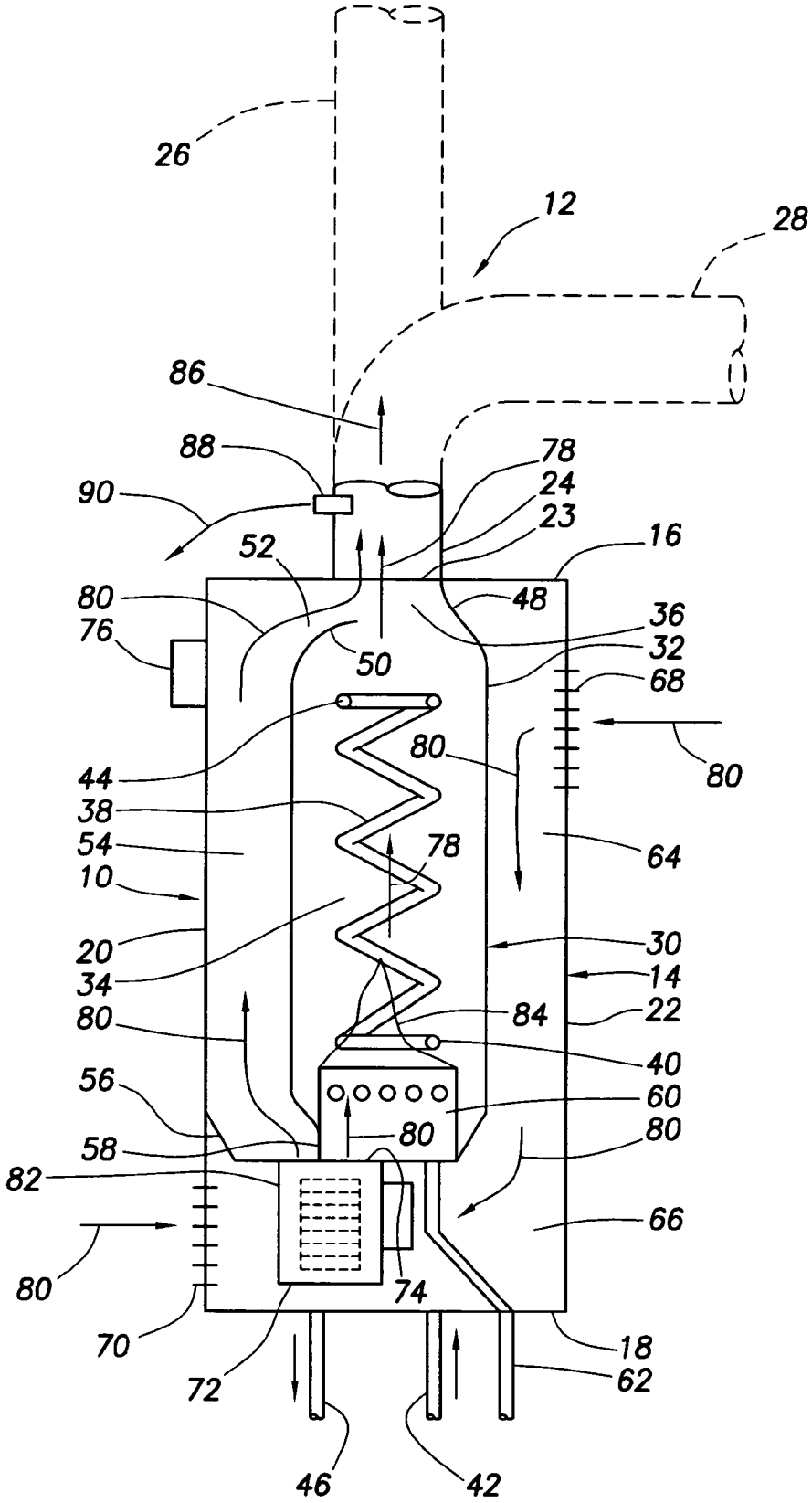
FIG. 1 is a schematic cross-sectional view through a specially designed fuel-fired instantaneous type water heater that embodies principles of the present invention and utilizes a low cost plastic vent system.

Schematically depicted in cross-section in FIG. 1 is a fuel-fired instantaneous type water heater 10 that embodies principles of the present invention and is uniquely useable with a low cost plastic vent system 12 as opposed to the conventional and considerably more expensive stainless steel vent system typically required in this water heater application.

Water heater 10 includes an outer housing 14 having top and bottom end walls 16,18 and opposite vertical wall portions 20,22 extending therebetween. Top end wall 16 has a combustion gas outlet opening 23 therein. The vent system 12, which may representatively be constructed from readily available low cost plastic (DWV-PVC) pipe and associated fittings, illustratively has a vertical inlet portion 24 connected to the top housing end wall 16. From this inlet portion 24, the vent system 12 may extend vertically as indicated by the phantomed flue portion 26, or horizontally as indicated by the phantomed flue portion 28.

Disposed within the outer housing 14, and horizontally inset from its vertical side wall portions 20 and 22, is a vertically elongated heat exchanger structure 30 having two primary portions in thermal communication with one another—(1) a wall structure 32 defining an enclosed combustion chamber 34 having a top outlet 36 communicated with the inlet portion 24 of the plastic vent system 12 via an upper interior portion of the outer housing 14 and the combustion gas outlet opening 23, and (2) a vertically coiled pipe heat exchanger portion 38 disposed within the combustion chamber 34 and having an inlet end 40 coupled to a pressurized cold water inlet pipe 42 external to the wall structure 32, and an outlet end 44 coupled to a hot water supply pipe 46 external to the wall structure 32. The interior of the coiled pipe 38 defines a first flow path adapted to receive and discharge a flow of fluid to be heated, and the combustion chamber 34 defines a second flow path in thermal communication with the first flow path and adapted to receive a flow of hot combustion gas and discharge it through the combustion gas outlet opening 23, as later described herein.

The previously mentioned top outlet 36 of the combustion chamber 34 is partially bounded by a closure portion 48 of the inner wall structure 32 which is connected to the top end wall 16 of the outer housing 14, and a rightwardly and upwardly sloped deflector portion 50 of the inner wall structure 32. For purposes later described herein, the deflector wall 50 forms with the top end wall 16 of the outer housing 14 a dilution air outlet passage 52 that communicates with the vertical inlet portion 24 of the plastic vent system 12 via the combustion gas outlet opening 23.

Disposed within the outer housing 14, and externally extending upwardly along a left side portion of the heat exchanger structure 30, is a bypass air passage 54 having a bottom end wall 56 and communicating with the inlet portion 24 of the plastic vent system 12 via the dilution air outlet passage 52. At the bottom end of the bypass air passage 54 the inner wall structure 32 has a vertical splitter wall portion 58 that extends upwardly along a left side portion of a variable firing rate fuel burner 60 disposed within a bottom interior end portion of the combustion chamber 54 beneath the bottom end of the coiled pipe heat exchanger 38. Burner 60 is supplied with gaseous fuel via a fuel supply pipe 62.

An air inlet passage 64 vertically extends along a right side interior portion of the outer housing 14, externally of the heat exchanger structure 30 between the outer housing top end wall 16 and an inlet plenum 66 extending along a bottom interior end portion of the outer housing 14 beneath the heat exchanger structure 30. An air inlet louver 68 is installed on an upper portion of the outer housing vertical side wall 22 and opens into the vertical air inlet passage 64, and an optional air inlet louver 70 is installed in a lower portion of the outer housing vertical side wall 20 and opens into the bottom inlet plenum 66.

A variable speed air blower 72 is disposed in the plenum 66 and has an outlet 74 positioned along the bottom sides of the burner 60 and the bypass air passage 54. The blower outlet 74 is divided by the splitter wall portion 58 into a first portion communicated with a lower interior end portion of the bypass air passage 54, and a second portion communicated with the interior of the burner 60.

During heated water delivery use of the instantaneous water heater 10, pressurized water is sequentially flowed inwardly through the pipe 42, through the coiled pipe heat exchanger portion 38, and then outwardly through the pipe 46 to one or more of the plumbing fixtures to which the water heater 10 is operatively connected. At the same time, under the control of a suitable main controller 76 operatively associated with the water heater 10, the variable firing rate burner 60 and the variable speed blower 72 are being operated.

Operation of the burner 60 causes it to generate within the combustion chamber 34 hot combustion gases 78. Operation of the blower 72 draws ambient air 80 external to the water heater 10 inwardly through the upper air inlet louver 68, downwardly through the vertical air inlet passage 64, into the bottom inlet plenum 66 and then into the inlet 82 of the blower 72. Additional ambient air 80 is drawn inwardly through the lower air inlet louver 70 into the bottom inlet plenum 66 and into the blower inlet 82.

A first portion of the air 80, from a portion of the blower outlet 74 to the right of the splitter wall portion 58 as viewed in FIG. 1, is forced into the burner as combustion air that mixes with burner-received fuel from fuel supply pipe 62 and is combusted to form a burner flame 84 that, in turn, creates the hot combustion gases 78. By operation of the variable speed blower 72, the hot combustion gases 78 are forced upwardly through the combustion chamber 34, upwardly through the top outlet 36, and into the vertical inlet portion 24 of the plastic vent system 12 via the combustion gas outlet opening 23. Combustion heat from these upwardly traveling flue gases 78 is transferred inwardly through the coiled pipe heat exchanger 38 to instantaneously heat water flowing therethrough from the cold water supply pipe 42 to the hot water supply pipe 46.

A second quantity of the air 80, to the left of the splitter wall portion 58 as viewed in FIG. 1, is forced by the blower 72 upwardly through the vertical bypass air passage 54 as cooling dilution air that passes upwardly through the dilution air outlet passage 52 is caused to mix with the combustion gases 78 being discharged from the combustion chamber 34 and form with the combustion gases 78 a substantially cooled combustion gas flow 86 (representatively having a temperature of less than about 200° F.) that enters and traverses the vent system 12. It is this use of blower-discharged dilution air, which is mixed with combustion chamber-discharged combustion gases, that advantageously permits the vent system 12 to be formed from relatively inexpensive plastic material instead of the previously utilized stainless steel material. The use of the deflector wall or plate 50 facilitates the impingement of the dilution air on the combustion gases 78 being discharged from the combustion chamber 34 and the mixing of these two gas streams to form the cooled combustion gas flow 86 entering and traversing the vent system 12.

As can be seen in FIG. 1, air 80 entering the outer housing 14 is caused to flow externally around the overall heat exchanger structure 30 (via the passages 64,66 and 54) to thereby absorb heat from the heat exchanger structure 30 and desirably reduce the exterior surface temperature of the outer housing 14.

If desired, a temperature sensing element, such as the schematically depicted thermistor 88 capable of generating a temperature-indicative output signal 90, may be used to monitor the temperature of the cooled flue gases 86 flowing through the vent system 12. The output signal 90 may be used to terminate or preclude firing of the burner 60 when the sensed flue gas temperature is unacceptably high, or may be fed to the main controller 76 and used thereby as a parameter in the control of the variable firing rate burner 60 and/or the variable speed blower 72.

Figure 2:
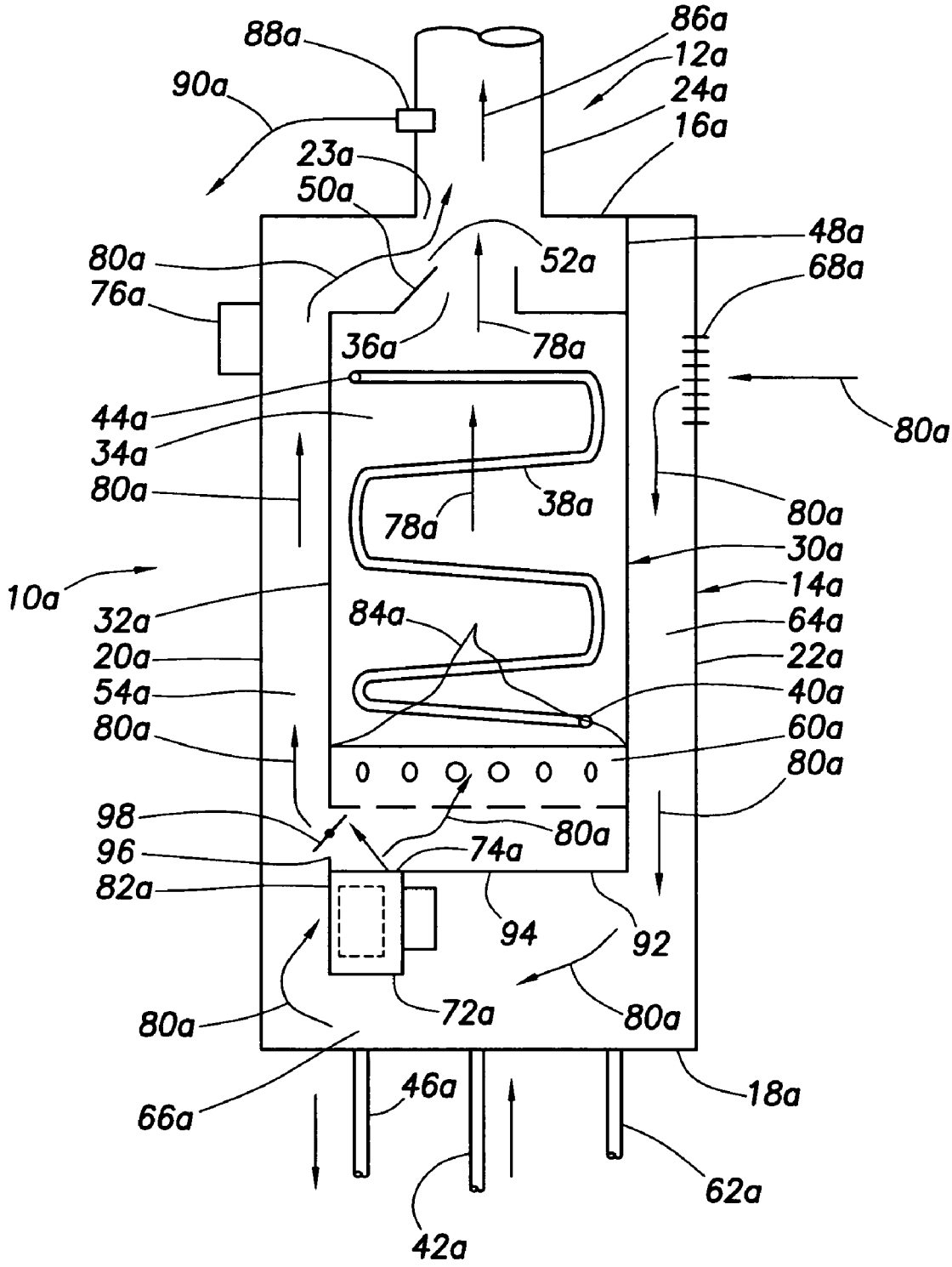
FIG. 2 is a schematic cross-sectional view through a first alternate embodiment of the FIG. 1 water heater.

A first alternate embodiment 10*a* of the previously described fuel-fired instantaneous type water heater 10 is schematically depicted in cross-section in FIG. 2. For purposes of ready comparison between the water heaters 10 and 10*a*, elements in the water heater 10*a* similar to those in the water heater 10 have been given identical reference numerals to which the subscripts "a" have been added.

The water heater 10*a* shown in FIG. 2 is quite similar in construction and operation to the water heater 10 shown in FIG. 1 with the primary exceptions that in the water heater 10*a* the optional lower air inlet louver 80 is representatively eliminated, the splitter wall 58 is eliminated, and the water heater 10*a* is provided with the capability of selectively varying the ratio of (1) the quantity of blower-discharged air 80*a* delivered to the burner 60*a* to (2) the quantity of blower-discharged air 80*a* flowed upwardly through the vertical bypass air passage 54*a*.

This blower-discharged air proportioning capability is provided by forming a plenum 92 beneath the burner 60*a*, the plenum 92 having a bottom wall 94 forming an upper boundary of the bottom inlet plenum 66*a*. Plenum 92 has an outlet opening 96 disposed beneath a bottom left corner portion of the burner 60*a* and communicating the plenum 92 with the vertical bypass air passage 54*a*. Blower 72*a*, located within the bottom plenum 66*a*, has its outlet 74*a* communicated with the plenum 92 just to the right of the outlet opening 96 as viewed in FIG. 2. A pivotable air flow proportioning damper 98 is operatively positioned in the outlet opening 96 and is appropriately controlled by the main controller 76*a* to selectively vary the ratio of (1) air 80*a* delivered to the burner 60*a* to (2) air 80*a* delivered to the vertical bypass air passage 54*a*.

This ratio may be adjusted using the thermistor temperature output signal 90*a* routed to the main controller 76*a* which, in turn, controls the damper 98 in addition to controlling the variable firing rate burner 60*a* and the variable speed blower 72*a*. Alternatively, the thermistor 88*a* (or other type of temperature sensing device as the case may be) may simply be utilized to shut the water heater 10*a* off when the thermistor-sensed flue gas temperature becomes unacceptably high.

Figure 3:
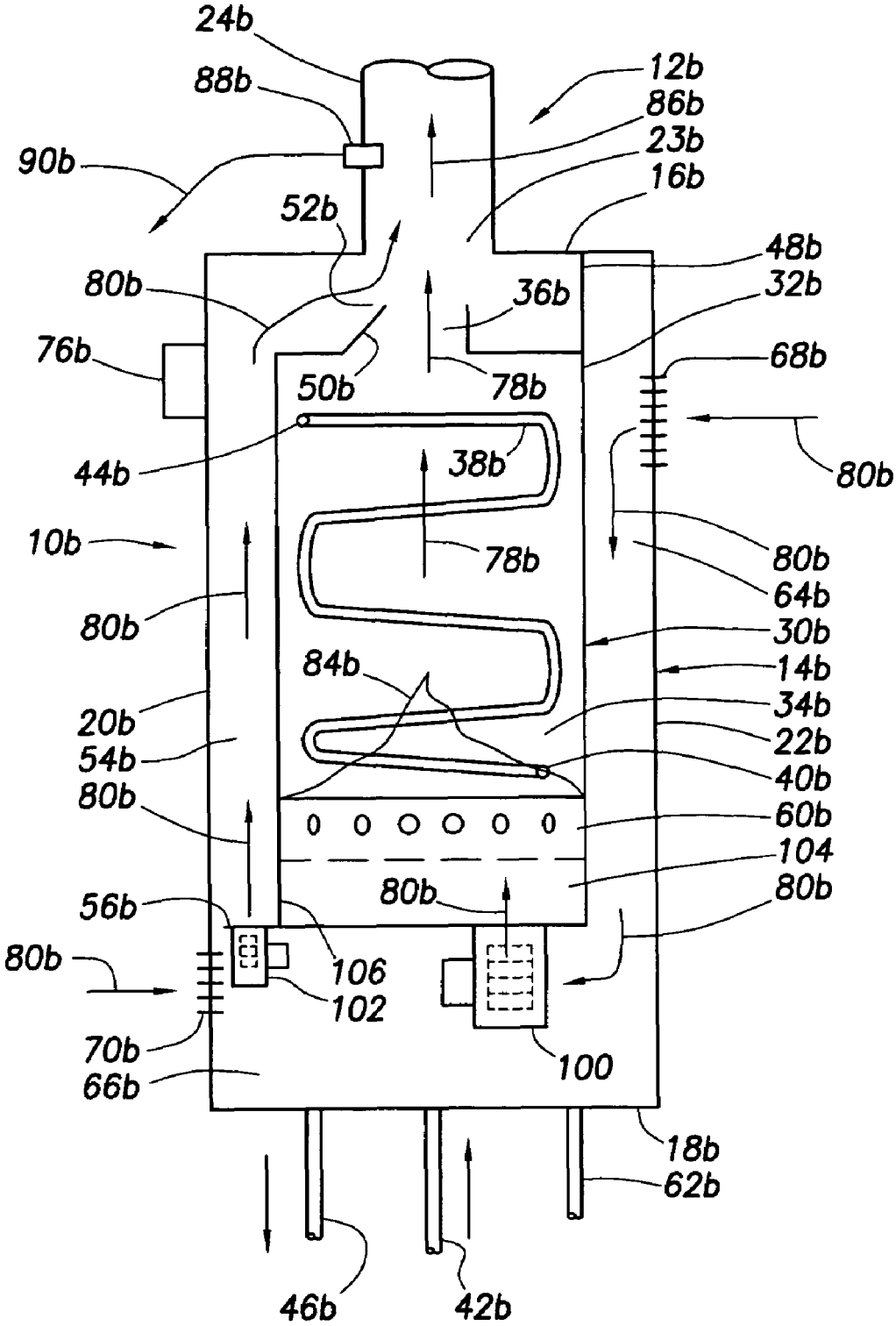
FIG. 3 is a schematic cross-sectional view through a second alternate embodiment of the FIG. 1 water heater.

A second alternate embodiment 10*b* of the previously described fuel-fired instantaneous type water heater 10 is schematically depicted in cross-section in FIG. 3. For purposes of ready comparison between the water heaters 10 and 10*b*, elements in the water heater 10*b* similar to those in the water heater 10 have been given identical reference numerals to which the subscripts "b" have been added.

The water heater 10*b* shown in FIG. 3 is quite similar in construction and operation to the water heater 10 shown in FIG. 1 with the primary exceptions that instead of the single air blower 72, two separate air blowers 100,102 (each located in the bottom plenum 66*b*) are utilized. Air blower 100 is used only to supply air 80*b* as combustion air to the burner 60*b* via a plenum 104 underlying the burner 60*b* and separated from the vertical bypass air passage 54*b* by a vertical wall portion 106. Blower 102, which, like the blower 100 is preferably a variable speed blower, is used only to supply air 80*b* as dilution/cooling air to the vertical air passage 54*b* through its bottom end wall 56*b*. Each of the blowers 100,102 is appropriately controlled by the main controller 76 which may utilize the thermistor output signal 90*b* as a parameter for controlling the variable firing rate burner 60*b* and the separate variable speed air blowers 100 and 102, or simply as a temperature-based safety shutoff signal.

In addition to the desirable result of the present invention of permitting the vent system of a fuel-fired instantaneous type water heater to be formed from a low cost plastic material, another desirable aspect of the invention is that it is air discharged from an air blower portion of the water heater which is utilized as flue gas dilution and cooling air. No flue gases are flowed through any blower portion of the water heater. Accordingly, the interior of such blower portion is not exposed to and chemically deteriorated by such flue gases. Moreover, the flow of ambient air through the outer housing desirably absorbs some of the heat from the internal heat exchanger structure and accordingly reduces the external surface temperature of the outer housing.

While the fuel-fired fluid heating devices shown in FIGS. 1-3 are representatively instantaneous type water heaters, principles of the present invention are not limited to instantaneous type fuel-fired water heaters and could alternatively be utilized in a variety of other types of fuel-fired fluid heating devices. Moreover, while the unique design of the instantaneous type water heater embodiments representatively illustrated and described herein permits them to utilize low cost plastic vent systems, it is not required that such water heaters be fitted with plastic vent systems—they could utilize other vent system materials, such as metal, without departing from principles of the present invention.

As illustrated, the instantaneous type water heaters representatively have upflow configurations. However, they could alternatively have downflow or horizontal flow configurations without departing from principles of the present invention. Further, while the fluid (water) being heated is flowed through a first heat exchanger flow path enveloped by a second heat exchanger flow path through which combustion gas flows, without departing from principles of the present invention the overall heat exchanger structure could be modified in certain instances in a manner such that the fluid being heated could be flowed through a flow path that is external to a flow path through which hot combustion gas flows.

The foregoing detailed description is to be clearly understood as being given by way of illustration and example only, the spirit and scope of the present invention being limited solely by the appended claims.

What is claimed is:

1. Fuel-fired fluid heating apparatus comprising:

an outer housing having a combustion gas outlet opening;

a heat exchanger structure disposed in said outer housing and having a first flow path extending therethrough and adapted to receive and discharge a flow of fluid to be heated, and a second flow path extending therethrough, said second flow path being in thermal communication with said first flow path and adapted to receive a flow of hot combustion gas and discharge it through said combustion gas outlet opening;

wall structure defining a third flow path external to said heat exchanger structure, said third flow path being interposed between and at least partially bounded by an interior surface portion of said outer housing and an exterior surface portion of said heat exchanger structure;

a fuel burner operative to receive fuel and pressurized combustion air from sources thereof, combust the received fuel and combustion air, and create said flow of hot combustion gas; and blower apparatus operative to (1) discharge a first flow of air into said fuel burner as pressurized combustion air, and (2) discharge a second flow of air into said third flow path as cooling air which flows along an interior surface portion of said outer housing and mixes with and cools combustion gas being discharged from said second flow path.

2. The fluid heating apparatus of claim 1 wherein:

the temperature of the cooled combustion gas is less than about 200° F.

3. The fluid heating apparatus of claim 2 further comprising:

a vent system extending outwardly from said combustion gas outlet opening and operative to receive and discharge the cooled combustion gas.

4. The fluid heating apparatus of claim 3 wherein:

said vent system is of a plastic material.

5. The fluid heating apparatus of claim 1 wherein:

said fluid to be heated is water, and said fluid heating apparatus is a fuel-fired instantaneous type water heater.

6. The fluid heating apparatus of claim 1 wherein:

said first flow path is enveloped by said second flow path.

7. The fluid heating apparatus of claim 6 wherein:

said second flow path is defined by a combustion chamber to which said fuel burner is operatively connected, and said first flow path is defined by a pipe structure extending through the interior of said combustion chamber.

8. The fluid heating apparatus of claim 1 wherein:

said wall structure further defines a fourth flow path, extending through the interior of said outer housing, for delivering ambient air to an inlet portion of said blower apparatus.

9. The fluid heating apparatus of claim 8 wherein:

said fourth flow path is interposed between and at least partially bounded by an interior surface portion of said outer housing and an exterior surface portion of said heat exchanger structure.

10. The fluid heating apparatus of claim 1 wherein:

said fuel burner is a variable firing rate fuel burner.

11. The fluid heating apparatus of claim 1 wherein:

said blower apparatus includes a single air blower having an outlet communicating with said fuel burner and said third flow path.

12. The fluid heating apparatus of claim 11 wherein:

said single air blower is a variable speed air blower.

13. The fluid heating apparatus of claim 11 wherein:

said wall structure further defines a splitter structure dividing air discharged from said blower outlet into a first portion flowed to said fuel burner, and a second portion flowed to said third flow path.

14. The fluid heating apparatus of claim 1 wherein:

said blower apparatus includes a single air blower, and said fluid heating apparatus further comprises proportioning apparatus operative to supply selectively variable portions of air discharged from said single air blower to said fuel burner and to said third flow path.

15. The fluid heating apparatus of claim 14 wherein:

said proportioning apparatus includes a plenum communicating with said fuel burner and said third flow path, and a damper installed at a juncture between said plenum and said third flow path, and said single air blower is operable to flow all of its discharged air into said plenum.

16. The fluid heating apparatus of claim 14 wherein:

said single air blower is a variable speed air blower.

17. The fluid heating apparatus of claim 1 wherein:

said blower apparatus includes a first air blower operative to discharge air only into said fuel burner, and a second air blower operative to discharge air only into said third flow path.

18. The fluid heating apparatus of claim 17 wherein:

said first and second air blowers are variable speed air blowers.

19. The fluid heating apparatus of claim 1 further comprising:

a temperature sensor operative to sense the temperature of the cooled combustion gas and responsively output a sensed temperature signal, and a control system operative to utilize said sensed temperature signal to control at least one operational aspect of said fluid heating apparatus.

20. A fuel-fired instantaneous type water heater comprising:

an outer housing having a combustion gas outlet opening;

a combustion chamber disposed within said outer housing;

a heat exchange structure, disposed within said combustion chamber for receiving a throughflow of water to be heated;

a fuel burner operable to create hot combustion gas within said combustion chamber;

a cooling air flow path external to said combustion chamber; and blower apparatus operative to (1) discharge a first flow of air into said fuel burner as pressurized combustion air which forces said combustion gas outwardly from said combustion chamber and outwardly through said combustion gas outlet opening, and (2) discharge a second flow of air into said cooling air flow path as cooling air which mixes with and cools combustion gas being discharged from said combustion chamber.

21. The water heater of claim 20 wherein:

the temperature of the cooled combustion gas is less than about 200° F.

22. The water heater of claim 21 further comprising:

a vent system extending outwardly from said combustion gas outlet opening and operative to receive and discharge the cooled combustion gas.

23. The water heater of claim 22 wherein:

said vent system is of a plastic material.

24. The water heater of claim 20 wherein:

said cooling air flow path is a first cooling air flow path, and said water heater further comprises a second cooling air flow path, extending through said outer housing, for delivering ambient air to an inlet portion of said blower apparatus.

25. The water heater of claim 20 wherein:

said blower apparatus includes a single air blower operative connected to discharge a fixed portion of its discharged air to said fuel burner, and the balance of its discharged air to said cooling air flow path.

26. The water heater of claim 20 wherein:

said blower apparatus includes a single air blower, and said water heater further comprises proportioning apparatus operative to cause selectively variable portions of the air discharged from said single air blower to said fuel burner and to said cooling air flow path.

27. The water heater of claim 20 wherein:

said blower apparatus includes a first air blower connected to flow its discharge air to said fuel burner, and a second air blower connected to flow its discharge air to said cooling air flow path.

28. The water heater of claim 20 wherein:

the quantity of discharged from said blower apparatus is selectively variable.

29. The water heater of claim 20 wherein:

said fuel burner is a variable firing rate fuel burner.

30. The water heater of claim 20 further comprising:

a temperature sensor operative to sense the temperature of the cooled combustion gas and responsively output a sensed temperature signal, and a control system operative to utilize said sensed temperature signal to control at least one operational aspect of said water heater.

* * * * *